United States Patent [19]

Holt

[11] 4,106,699

[45] Aug. 15, 1978

[54] RECIRCULATING PAINT FLOW CONTROL DEVICE

[75] Inventor: Earl R. Holt, Rochester, Mich.

[73] Assignee: Hose Specialties Company, Detroit, Mich.

[21] Appl. No.: 762,050

[22] Filed: Jan. 24, 1977

[51] Int. Cl.[2] ..... B05B 9/04

[52] U.S. Cl. ..... 239/124; 239/127

[58] Field of Search ..... 138/43–46; 239/124–127; 251/297

[56] References Cited

U.S. PATENT DOCUMENTS

| | | | |
|---|---|---|---|
| 2,244,686 | 6/1941 | Garrison et al. | 239/126 X |
| 2,598,961 | 6/1952 | Andrus | 138/43 X |
| 2,720,845 | 10/1955 | Whitlock, Jr. | 251/297 |
| 3,023,968 | 3/1962 | Mitchell | 239/125 |
| 3,630,236 | 12/1971 | Diggs | 138/45 |

FOREIGN PATENT DOCUMENTS

| | | | |
|---|---|---|---|
| 423,645 | 2/1935 | United Kingdom | 138/44 |

*Primary Examiner*—John J. Love

*Attorney, Agent, or Firm*—Harness, Dickey & Pierce

[57] ABSTRACT

A flow control device for use in recirculating liquid coating composition systems adapted to be connected directly to the spray apparatus, such as an air atomizing spray gun or the like. The flow control device assures a continuous supply of a uniform liquid coating mixture to the spray nozzle at an adjustable desired pressure.

11 Claims, 7 Drawing Figures

FIG. 1.
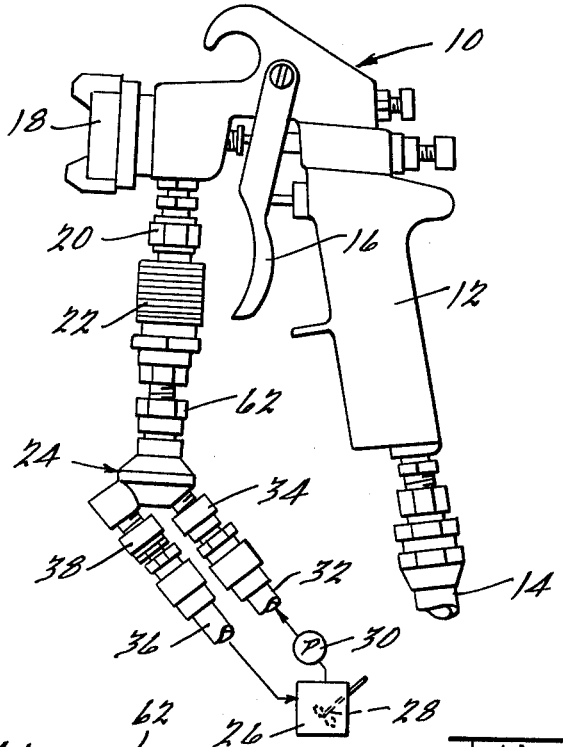
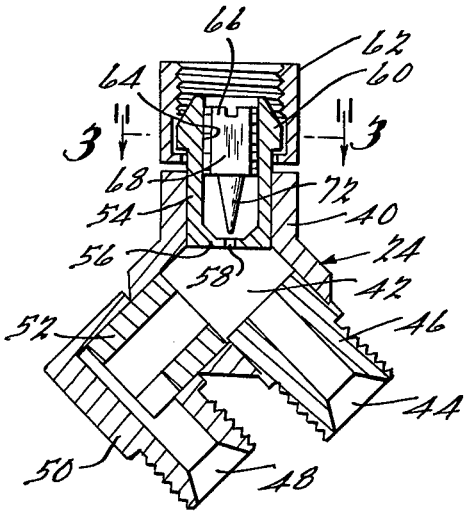
FIG. 2.
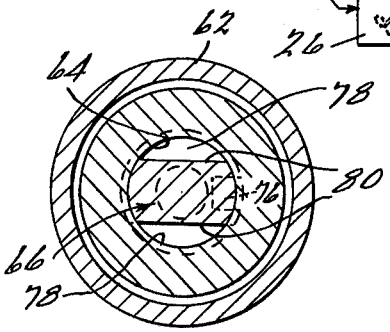
FIG. 3.
FIG. 4.
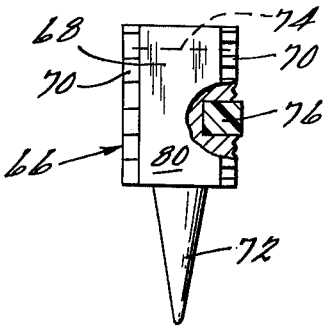
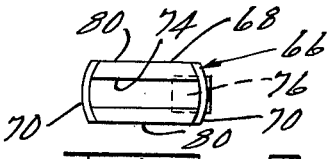
FIG. 5.
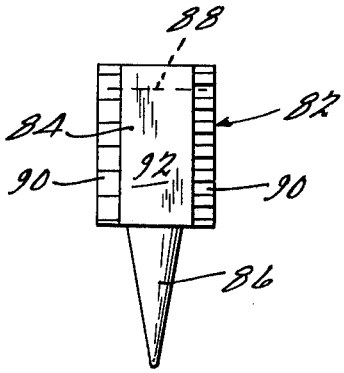
FIG. 6.
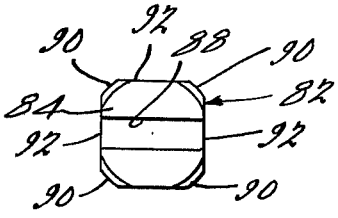
FIG. 7.

RECIRCULATING PAINT FLOW CONTROL DEVICE

BACKGROUND OF THE INVENTION

Recirculating-type liquid coating or paint systems are in widespread commercial use for keeping heavily-bodied pigments uniformly suspended in the liquid paint, assuring thereby uniformity in the color and quality of the paint film applied to a substrate. Such circulating paint systems conventionally comprise a mixing tank equipped with suitable agitation for maintaining the paint uniformly mixed and a pump for transferring the liquid paint under the desired pressure to an automatic or manual spray nozzle. A suitable return line is provided for returning the excess paint back to the mixing tank. At the juncture of the pressurized paint supply line and the spray nozzle, a suitable flow control device is mounted for regulating the amount and pressure of paint in the recirculating system to be supplied directly to the nozzle.

Various flow control devices or paint restrictors have heretofore been used or proposed for use including diaphragm-type regulators, for controlling the flow rate of the paint supply to the spray nozzle. Unfortunately, such prior art constructions of flow regulators have been handicapped by their tendency to become progressively plugged over periods of use, necessitating frequent replacement and/or down time to permit cleaning to restore them to proper operating conditions. The build-up of deposits in such flow regulators causes a progressive decrease in the pressure of the liquid coating composition supplied to the nozzle, whereby variations in the quality and thickness of the coating occurs, also detracting from their use.

The flow control device of the present invention overcomes many of the problems and disadvantages associated with prior art structures, providing a simple, economical and durable device which can be directly connected to the fluid inlet of a conventional spray gun and is readily adjustable to provide the desired pressure and flow rate of liquid coating compositions over prolonged time periods without incurring any significant plugging or variation in the preset flow pattern.

SUMMARY OF THE INVENTION

The benefits and advantages of the present invention are achieved by an improved flow control device for use in a paint spray apparatus including as its essential elements, a spray nozzle and a recirculating paint supply system adapted to supply a liquid coating composition to the spray nozzle under pressure in an amount in excess of that required. The flow control device comprises a body incorporating a flow chamber through which the high volume of liquid paint continuously passes to maintain the suspended constituents therein in the form of a substantially uniform dispersion, and wherein the body is also provided with an elongated discharge port which defines an axial chamber having a base at its inner end formed with an orifice therethrough, which is disposed in communication with the paint flowing through the flow control device. The discharge port further incorporates a coupling at the outer end thereof for coupling the axial chamber in communication with the fluid supply line of a spray nozzle. The axial chamber is provided with a threaded section along a portion thereof and a flow control meter valve, included a threaded body portion, is disposed in threaded engagement in the threaded section. The needle valve further includes a tapered end portion disposed in adjustable flow restricting relationship and axial alignment relative to the orifice in the base of said axial chamber. The axial chamber and needle valve are formed with at least one axially extending channel to provide communication between the inner end and the outer end of said axial chamber to permit flow of liquid coating composition to the nozzle device as required. The foregoing arrangement provides for self-cleaning characteristics, preventing any significant build-up of deposits on the several metering surfaces, assuring satisfactory operation over prolonged time periods.

BRIEF DESCRIPTION OF THE DRAWING

FIG. 1 is a side elevational view, partly schematic, of a typical air atomizing type spray gun incorporating a flow control device connected to a recirculating paint system in accordance with the preferred embodiments of the present invention;

FIG. 2 is a sectional view of the flow control device shown in FIG. 1;

FIG. 3 is a transverse horizontal sectional view through the outlet port and valve chamber of the flow control device shown in FIG. 2 as viewed substantially along the line 3—3 thereof;

FIG. 4 is an enlarged side elevational view, partly in section, of the tapered needle valve shown in FIGS. 2 and 3;

FIG. 5 is a plan view of the upper end of the needle valve shown in FIG. 4;

FIG. 6 is a side elevational view of a needle valve constructed in accordance with an alternative embodiment of the present invention; and FIG. 7 is a plan view of the upper end of the needle valve shown in FIG. 6.

DESCRIPTION OF THE PREFERRED EMBODIMENTS

Referring now in detail to the drawings, and as may be best seen in FIG. 1, the benefits and advantages of the flow control device comprising the present invention are achieved in a recirculating-type paint system typically including a spray gun 10 of the conventional air atomization type, including a hand grip 12, the butt end of which is connected to a hose 14 for supplying pressurized atomizing air to the spray nozzle. The spray gun is further provided with a pivotally mounted trigger 16 for controlling the discharge of an air atomized spray of paint from a mixing nozzle 18 at the forward end thereof. The internal structural arrangements of the spray gun 10 can be of any of the types well known and commercially available. It will be understood that in addition to the air atomization type spray gun shown in FIG. 1, the flow control device of the present invention is also applicable to automatic spray nozzle arrangements of the various types typically employed for spray painting automobile and other vehicle bodies in automobile manufacturing plants.

In either event, the spray gun or spray nozzle is provided with a coupling 20 connected to a fluid passage disposed in communication with the mixing nozzle 18, which in turn in connected by means of a quick disconnect coupling 22 to the flow control or metering device, indicated at 24 in FIG. 1. The quick disconnect coupling 22 may be of any of the well known constructions and facilitates disconnection of one recirculating paint system from the spray nozzle and reconnection to another recirculating paint system of a different color.

The recirculating paint supply system incorporating the flow control device 24, as schematically illustrated in FIG. 1, conventionally includes a mixing tank 26 incorporating suitable agitation means 28 for maintaining the constituents of the liquid coating composition in uniform suspension. The liquid coating composition is continuously recirculated and pumped under pressure by means of a pump 30 through a supply conduit 32 connected by means of a coupling 34 to the inlet side of the flow control device 24 and the excess portion thereof is returned through a return conduit 36 connected by means of a coupling 38 to the outlet side of the flow control device. Conventionally, the quantity of paint circulated and the rate of circulation thereof is substantially in excess of that required for discharge for the nozzle of the spray device to assure that no stratification and/or setting of the suspended constituents in the liquid coating formulation, such as pigments and the like, occurs in the various interconnecting conduits of the supply system. It is not uncommon in commercial installations to continue circulation of the paint 24 hours a day to assure uniformity in composition and quality at all times.

The terms "paint" or "liquid coating composition", as herein employed and set forth in the subjoined claims, are intended to encompass any one of a variety of liquid coating compositions conventionally comprising a vehicle including a binder and a solvent therefore in further combination with various particulated pigment and/or filler materials.

Referring now to FIGS. 2–5 of the drawing, the flow control device 24 comprises a body 40 defining an internal chamber 42 having an inlet port 44 as defined by an inlet coupling 46 brazed or otherwise affixed in sealed relationship to the body and having a threaded periphery for removably connecting the body to the pressurized supply conduit 32 via the coupling 34 as illustrated in FIG. 1. Similarly, the body is formed with an outlet port 48 defined by a threaded coupling 50 brazed in encircling relationship around a bushing 52 integrally secured together, such as by brazing for example. The threaded coupling 50 is adapted to be connected to the return conduit 36 by means of the coupling 38 in accordance with the arrangement illustrated in FIG. 1. The body is further formed with a discharge port, as defined by an elongated tubular bushing 54, secured affixed to the body such as by means of brazing, which is formed at its inner end with a base 56 having an orifice 58 extending therethrough disposed in communication with the internal chamber 42. The outer end portion of the tubular bushing 54 is provided with an enlarged tapered head 60 around which a flanged internally threaded nut 62 is disposed, forming a swivel connector for coupling the discharge side of the flow control device to the inlet side of the quick-disconnect coupling as shown in FIG. 1.

The interior of the tubular housing 54 in combination with the base 56 defines an elongated axial chamber and the interior wall portion thereof is threaded, as indicated at 64, providing a threaded section in which a tapered flow control or needle valve 66 is threadably engaged. The needle valve 66, as best seen in FIG. 2–5, comprises a threaded body portion 68, having thread segments 70 extending axially along the length thereof and a tapered needle portion 72 adapted to be disposed with the tapered end portion thereof in adjusted flow obstruction relationship relative to the outlet of the orifice 58. The axis of the tapered needle portion 72 of the needle valve is disposed in substantial axial alignment with the axis of the orifice 58 such that inward or outward threaded adjustment of the needle valve provides for corresponding adjustments in the amount of paint passing outwardly through the tubular bushing 54. Conventionally, recirculating paint supply systems operate at supply pressures up to about 200 psi and the flow control device is operative to reduce and regulate the flow rate to the spray nozzle.

As shown in FIGS. 4 and 5, the outer head portion of the needle valve is provided with a transverse slot 74 enabling engagement thereof, such as by means of a screwdriver, to permit axial adjustment thereof within the axial chamber. Inadvertent movement of the needle valve relative to the threaded section of the tubular bushing is restricted by means of a deformable slug indicated at 76, such as of nylon plastic, for example, which is disposed in interferring relationship between the threaded portion of the threaded section, providing therewith a thread drag. The slug 76 is bonded or otherwise mechanically interlocked within an appropriate cavity formed in the body portion of the needle valve.

The liquid coating composition or paint entering the axial chamber through the orifice 58, as permitted by the axial spacing of the end of the needle valve, passes upwardly, as viewed in FIG. 2, past the body section of the needle valve through axially extending arcuate channels 78 provided along the sides of the body portion and indicated at 80 in FIGS. 3–5. In the specific arrangement shown, the recessed surfaces 80 are in the form of axially extending flats corresponding to a chordal plane along diametrically disposed sides of the needle valve and are positioned in relative parallelism to each other. The corresponding clearance provided between the flat surfaces 80 and the inner wall of the tubular bushing 54 provides channels of substantial cross sectional area which are not susceptible to plugging by the liquid coating composition in spite of periods of stagnation of the composition within the axial chamber. The small diameter coupled with the small axial length of the orifice 58 and the high velocity of paint passing therethrough provides for a self-cleaning action of the metering valve section.

An alternative satisfactory embodiment of a needle valve 82 is illustrated in FIGS. 6 and 7. As shown, the needle valve includes an enlarged body section 84 and a tapered needle portion 86 extending axially therefrom. The opposite end of the body portion is formed with a transverse slot 88 and the periphery of the body portion is formed with four arcuately spaced thread segments 90 extending in a helical pattern axially along the length of the body portion. The thread segments 90 are conveniently produced by machines such as grinding flat axially extending portal planes 92 at 90° intervals along the length of the body section, which define in combination with the threaded peripheral section of the axial chamber of the flow control device, four separate axial channels for transmitting the liquid paint to the inlet side of the spray nozzle.

The several components of the flow control device are preferably comprised of a material resistant to chemical and/or corrosive attack of the liquid coating composition such as a stainless steel. The several couplings of which the flow control device is comprised are preferably assembled in fluid-tight sealed relatinship by means of vacuum brazing employing nickel-base brazing alloys. The orientation of the coupling defining the inlet port 44 and outlet port 48, as best seen in FIGS. 1 and 2, is preferably such that the axes of these ports are disposed substantially parallel, wherein the supply and return conduits 32, 36, extend in substantially parallel relationship and facilitate manual manipulation of the spray gun. The axis of the inlet port and inlet coupling 46 as shown in FIG. 2 preferably is oriented so as to impinge on the base of the tubular bushing 54 and the orifice 58 therethrough, providing an abrading self-cleaning action in response to the continued circulation of liquid paint therethrough.

While it will be apparent that the invention herein described is well calculated to achieve the benefits and advantages set forth above, it will be appreciated that the invention is susceptible to modification, variation and change without departing from the spirit thereof.

What is claimed is:

1. In a paint spray apparatus including a spray nozzle and a recirculating paint supply system for supplying a liquid coating composition to the spray nozzle in an amount in excess of that required, the improvement comprising a flow control device in the recirculating suppy system for regulating the amount of paint supplied to the spray nozzle, said flow control device comprising a body formed with an internal chamber having an inlet port adapted to be connected to a supply conduit connected to a supply of pressurized paint, an outlet port connected to a return conduit for returning the excess of the recirculating paint to the paint supply and an elongated discharge port defining an axial chamber formed with a base at its inner end and having an orifice therethrough disposed in communication with said internal chamber and an outer end provided with coupling means for coupling said axial chamber in communication with a spray nozzle, said inlet port oriented with its axis aligned toward said base of said axial chamber and said orifice therethrough so that the paint entering said flow control device impinges on said base and said orifice providing for a self-cleaning action, said discharge port provided with a threaded section extending axially along the inner wall of said axial chamber, a flow control needle valve including a threaded body portion disposed in threaded engagement in said threaded section and a tapered end portion disposed in adjusted flow restricting relationship and axial alignment relative to said orifice, said axial chamber formed with a least one axially extending channel between said threaded section and said threaded body portion providing a communicating channel between said inner end and said outer end of said axial chamber.

2. The apparatus as defined in claim 1, further including retaining means associated with said threaded section and said threaded body portion for restricting inadvertent movement between said needle valve and said body.

3. The apparatus as defined in claim 1, in which said threaded body portion is of a circular cylindrical configuration and is formed with at least one axially extending groove along the threaded periphery thereof to define said axially extending channel.

4. The apparatus as defined in claim 2, in which said retaining means comprises a deformable insert interposed in interferring relationship between the threads of said threaded body portion and said threaded section.

5. The apparatus as defined in claim 4, wherein said insert is of nylon and is mounted in a recess formed in said threaded body portion of said needle valve.

6. The apparatus as defined in claim 3, in which said body portion is formed with two diametrically opposed axially extending grooves defined by axially extending planes disposed in substantial parallel relationship to each other.

7. The apparatus as defined in claim 1, in which said coupling means comprises a swivel connector.

8. The apparatus as defined in claim 1, in which said spray nozzle of said spray apparatus comprises a spray gun of the air atomization type.

9. The apparatus as defined in claim 1, in which the axis of said inlet port and said outlet port are substantially parallel.

10. The apparatus as defined in claim 1, in which the outer end of said body portion of said needle valve is formed with engaging means to effect engagement thereof and rotation of said needle valve to provide appropriate axial adjustment of the disposition of said tapered end portion relative to said orifice.

11. The apparatus as defined in claim 1, in which the axis of said inlet port and said outlet port are disposed substantially parallel to each other and are oriented in a direction extending angularly downwardly and rearwardly of the direction of spray of the coating composition from the spray nozzle.

* * * * *